United States Patent [19]

Descos et al.

[11] Patent Number: 4,802,676

[45] Date of Patent: Feb. 7, 1989

[54] CLAY PIGEON HAVING AT LEAST ONE SEALED RECESS CONTAINING A PRODUCT PRODUCING A CLOUD PERMITTING VISUALIZATION IN SPACE OF THE IMPACT AND/OR DURING FLIGHT

[75] Inventors: Rene Descos, Uchaud; Jean-Claude Laporte, Biot, both of France

[73] Assignee: Cibles Descos S.A.R.L., Vauvert, France

[21] Appl. No.: 890,727

[22] Filed: Jul. 30, 1986

[30] Foreign Application Priority Data

Aug. 1, 1985 [FR] France ..... 85 11930
Jun. 18, 1986 [FR] France ..... 86 08889

[51] Int. Cl.[4] ..... F41J 9/16; F41J 1/16; F42B 11/16

[52] U.S. Cl. ..... 273/363; 273/384; 102/513

[58] Field of Search ..... 273/362, 363, 364, 378, 273/379, 383, 384; D22/113; 102/504, 505, 513, 342

[56] References Cited

U.S. PATENT DOCUMENTS

| | | | |
|---|---|---|---|
| 287,985 | 11/1883 | Woeber | 273/363 |
| 295,312 | 3/1884 | Varwig et al. | 273/363 |
| 957,742 | 5/1910 | Chiantore | 273/363 |
| 975,711 | 11/1910 | Newbold | 273/363 |
| 1,369,830 | 3/1921 | Mitchell | 273/363 |
| 1,966,342 | 7/1934 | Gerdes | 273/363 |
| 2,250,252 | 7/1941 | Bingham, Jr. et al. | 273/363 |
| 4,335,882 | 6/1982 | Della Rovere | 273/363 |
| 4,352,496 | 10/1982 | Lanti-Mantefeltro Della Rovere | 273/363 |

FOREIGN PATENT DOCUMENTS

| | | | |
|---|---|---|---|
| 761729 | 3/1934 | France | 273/363 |
| 2257072 | 8/1975 | France . | |
| 577539 | 12/1958 | Italy | 273/363 |
| 12770 | 4/1895 | United Kingdom | 273/363 |
| 657459 | 9/1951 | United Kingdom | 273/363 |
| 2130894 | 6/1984 | United Kingdom . | |

OTHER PUBLICATIONS

"Seagram's" advertisement taken from Sports Illustrated Apr. 23, 1984; p. 50.

*Primary Examiner*—Richard C. Pinkham
*Assistant Examiner*—Mark S. Graham
*Attorney, Agent, or Firm*—Young & Thompson

[57] ABSTRACT

A target or clay pigeon may comprise a stopper for hermetically sealing an outlet hole. The stopper may automatically or non-automatically open the outlet hole. In one embodiment, the outlet hole (91) is hermetically sealed by a film (92) with a thread integrated with this stopper, the free extremity of which departs from the film (92) and is connected to a weight (94). With the rotation of the clay pigeon or target, the weight (94) pulls on the wire and tears the stopper, thus freeing the colored material.

2 Claims, 12 Drawing Sheets

FIG. 10
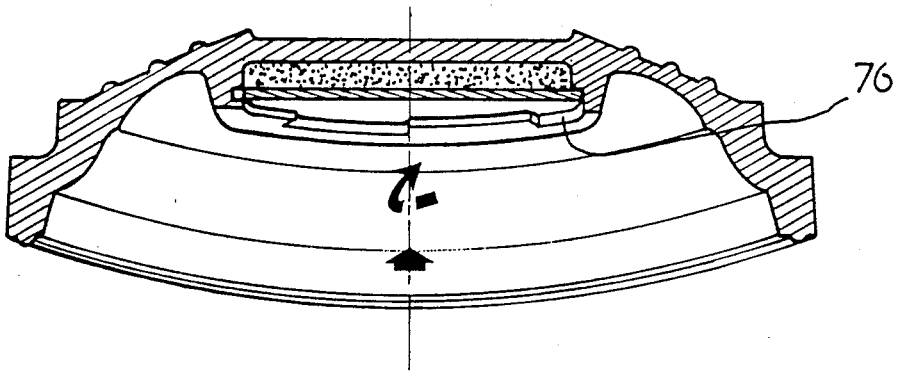
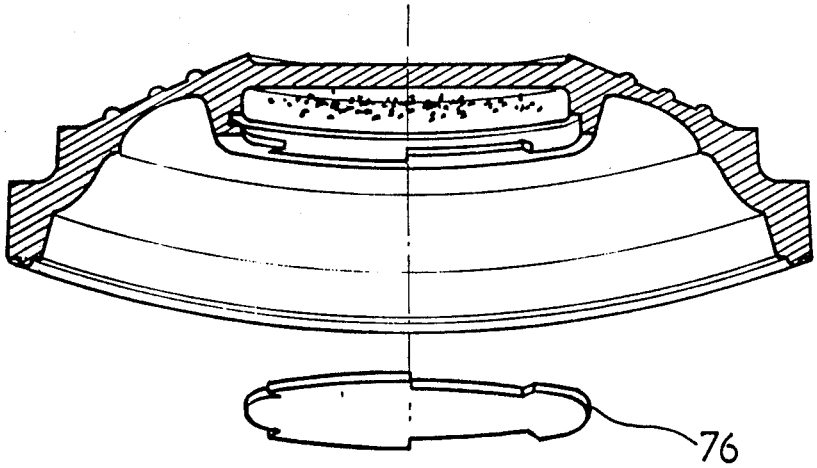
FIG. 11

CLAY PIGEON HAVING AT LEAST ONE SEALED RECESS CONTAINING A PRODUCT PRODUCING A CLOUD PERMITTING VISUALIZATION IN SPACE OF THE IMPACT AND/OR DURING FLIGHT

It is important for a marksman to be able to see the exact location -height, distance and angle- where a clay pigeon has been hit. To this end, some pigeons are equipped with colored ribbons of fabric or confetti or other material. These ribbons are ballasted and permit visualizing the falling of the debris from the clay pigeon which cannot always be seen. These colored ribbons are maintained interior of the clay pigeon at the top of its concave portion by metallic leaves which serve as springs or fasteners.. At present, these devices occupy a large portion of the interior of the pigeon. The clay pigeon according to the invention comprises an appropriate amount of colored powder, housed interiorly of the pigeon, between its interior concave portion and its planar portion, or exteriorly, between its convex and its exterior planar portion. A diaphragm hermetically seals the housing. The diaphragm may be planar and especially comprises conical edges adapted to the taper of either the interior surface or the exterior surface of the pigeon.

A circular web or flange may be provided at the level of the diaphragm; it serves to render the said diaphragm more rigid. Moreover, this web will face the upper flange of the lower pigeon on which the pigeon is stacked; the said flange permits a better positioning of the pigeons on each other.

According to another embodiment, the diaphragm comprises a central portion which is planar, a circular flange with reverse slope, then a planar portion to form a truncated cone which comes to fit together hermetically, by a conical surface, against the internal surface of the pigeon.

The diaphragm is maintained in place by gluing, which ensures at the same time the perfect sealing of the housing which contains the powder.

The diaphragm, according to a preferred embodiment, is made from the same material as the pigeon, for example, from pitch and carbonate. A means for gluing and hermetically sealing the housing with the diaphragm may consist of positioning the said diaphragm in a heated state. The deformation due to the heat permits the positioning of the diaphragm and assures the sealing of the housing by the diaphragm.

According to another embodiment, the diaphragm is pasteboard or plasticized pasteboard. The realization of a diaphragm in this material may be interesting for resolving the problem of the weight of the pigeon.

The state of the art may be defined by the following patents:

MITCHELL, U.S. Pat. No. 1,369,830

This patent describes a target or clay pigeon for a "ball trap" with the housing at the interior of the target, at the level of its concave portions; the said housing is closed by a diaphragm.

The diaphragm contains a visualization means such as powder or confetti which, at the moment of impact, is liberated and forms a cloud.

The housing may comprise vertical surfaces for forming several housings for varying the nature of the visualization products. The target is adapted to be stackable.

This target does not have the accepted characteristics of targets for target shooting. It requires changing the characteristics of the launchers of the target. It does not always break the housing at the moment of impact.

ROULET French No. 2,257,072

This patent describes a pyrotechnic target which comprises, on its exterior convex portion, a press cake of a flammable material with one or several igniters such as strikers which assure the ignition upon division of the target.

TAYLOR British No. 2,130,894

This patent describes two targets assembled edged to edge so as to delimit a closed cavity, with means provided at the interior of the said cavity to obtain an increased visual effect.

This target is not stackable, thus it may not be launched automatically. This target flies poorly and does not have the accepted characteristics of targets for target shooting.

BINGHAM, U.S. Pat. No. 2,250,252

This patent describes a target comprising, by its V-shaped profile, brittle regions facilitating the fracture of the said target at the moment of impact.

GERDES, U.S. Pat. No. 1,966,342

This target comprises, on its interior concave face, a metallic leaf which serves as a spring, and which maintains colored ribbons against the said surface.

These various targets have been unsuccessful.

The simplest and most efficient cannot be stacked, and thus cannot be launched automatically; they are therefore excluded from any industrial production.

The others, by their technical characteristics, considerably modify the weight of the target, and thus its flight, with respect to other targets without visualization products.

Thus, it is important that the targets containing these visualization products have technical characteristics, above all of flight, identical to known targets without visualization products.

It is also interesting if the flight of the target can be followed by spectators and/or the marksman up to the time of the final cloud, provoked by the impact of the projectile which fractures the target and liberates the visualization product or products.

The housings described in the cited patents cannot contain large quantities of visualization products and the height of the housing is about 15 centimeters.

Thus, the weight of a target must be comprised between 100 and 110 grams. The weight of the product must be very low, and the product must perform very well under the force provided.

The clay pigeon according to the invention comprises a suitable quantity of colored powder, housed interiorly of the pigeon, between its interior concave part and its planar part, or exteriorly, between its convex part and its exterior planar part. A diaphragm hermetically seals the housing. The diaphragm may be planar and especially comprises conical edges adapted to the taper of either the interior surface or the exterior surface of the pigeon.

A circular web or flange may be provided at the level of the diaphragm; it permits rendering the said diaphragm more rigid. Moreover, this flange comes to face the upper flange of the lower pigeon on which the pigeon is stacked; the said flange permits a better positioning of the pigeons on each other.

According to another embodiment, the diaphragm comprises a central portion which is planar, a circular flange with reverse slope, then a frustoconical planar portion which is applied hermetically by a conical surface, against the internal surface of the pigeon.

The diaphragm is maintained in position by gluing, which assures at the same time the perfect sealing of the housing which contains the powder.

The diaphragm, according to a preferred embodiment, is made from the same material as the pigeon, for example from pitch and carbonate. A means for gluing and hermetically sealing the housing via the diaphragm may consist of positioning the said diaphragm under the action of heat. The deformation due to the heat permits the positioning of the diaphragm and assures the sealing of the housing by the diaphragm.

According to another embodiment, the diaphragm is pasteboard or plasticized pasteboard. The realization of this diaphragm in this material may be interesting for resolving the problems of the weight of the pigeon. The target according to the invention uses a powder the technical characteristics of which, given by way of example, are the following:

mean diameter of the particle: 1 $\mu$ to 5 $\mu$
non-toxic fluorescent pigment
specific gravity: $\delta$ 1.14$\leqq$1.37
union at about: 115° C.
chemical nature: fluorescent solid solution in melanin formaldehyde fixed on polyamide supports or thermoplastic polyamide resin or sulfonamide resin.

The powder employed may thus use a housing the height of which may be about 0.5 centimeter and the weight of the powder between 0.4 and 1 gram.

The target does not change in weight and does not change in shape with respect to known targets.

To this end, the diaphragm is formed in a semi-rigid material (pasteboard or plasticized pasteboard) and positioned by force fitting in a horizontal peripheral groove provided to this end at the level of the extremity of the wall of the housing. This diaphragm of pasteboard or plasticized paper may simply be glued against the main body of the target, without creating to this end a specific housing for a target of a known type.

The diaphragm may be made in a transparent, semi-rigid material, which permits visualizing the color of the colored powder. This characteristic may be interesting particularly for games, where the targets are all loaded with, for example, an orange-colored powder and where a marksman randomly breaks a colored target of another color (for example green-colored powder) and wins a prize.

According to another embodiment, the sealing between the housing and the target may be provided by the shape of the surfaces of the housing and the shape of at least one annular wall disposed beneath the dome of the target. These shapes together form a "baffle" which assures a better sealing of the housing.

It does not matter if it is the diaphragm which forms the housing, and the target the cover or if the diaphragm may serve only as a closing diaphragm and the housing itself is closed by the surface of the said target.

So as to facilitate the complete fracture of the target and the opening of the housing to liberate the visualization product, according to another embodiment, the closing and sealing between the housing and the cover is not made by a continuous string of glue, but by at least two points of glue, the sealing being assured in this case above all by the baffle formed by the shapes of the housing and cover.

So as to facilitate the opening of the housing when the target is hit, the housing may be integral with exterior elements which serve as sensors and transmitters of impact. To this end, an exterior band is fixed to the housing and comes in contact via its periphery with the edges of the target, thus increasing the surface of contact between the target and the housing. This band, at the time the target is struck, transmits shock waves to the housing, which provokes its opening, even if the impact occurs outside the region of the said housing, for example on the edges of the target.

The means, serving as a sensor, may be an assembly of radiating flanges issuing from the housing, in contact with the housing by at least one extremity and in contact with the edge of the target by the other extremity.

According to another embodiment, the diaphragm ensures the tight closure of the housing by a quarter turn or bayonet closure system. To this end, the diaphragm as well as the housing are cut in a manner specific to this type of closure.

The quality of the visualization product, a decrease of the volume requires providing a housing which, however small it may be, will always be destroyed at the moment of impact.

With this in mind, the housing may be disposed in at least one annular region, a ring or band disposed interiorly of the target or exteriorly. The ring is formed by an annular housing which is fixed against the main body of the target, at the level of the dome or rim of the target.

Embrittlement regions of the target may be provided at the level of the housing or housings. These regions may particularly be a narrowing of the thickness of the target at this level, this narrowing being compensated by the weight of the powder and/or the sealed housing. These brittle, sensitive regions permit the fracture, even if the impact takes place lower on the target.

According to another embodiment, the target or clay pigeon may comprise a means serving as a stopper which hermetically seals an outlet hole. This stopper may open the outlet automatically, or not. This device permits following by the traces, the flight of the clay pigeon.

According to the embodiment, the sealed housing comprises a small escape hole closed by a force-fitted stopper. The outlet hole is situated at the periphery of the housing, and the stopper has a profile such that rotation of the target ejects the said stopper, freeing the outlet hole which thus allows to escape a fine stream or trail of powder.

According to another embodiment, the outlet hole is hermetically sealed by a film of paper, plastic or the like, with, as automatic opening means, a wire integrated with this stopper, the free extremity of which departs from said film and is connected to a weight. With the rotation of the clay pigeon or of the target, the weight, under the effect of the centrifugal force, pulls on the wire and tears the stopper, thus freeing the colored product.

According to another embodiment, the sealed housing is closed by a diaphragm the outlet hole of which is closed by a stopper on which a stud is formed. At the moment of launching the target, a projection disposed on the launcher upsets the stud and its stopper, thus opening the outlet hole.

The clay pigeons or targets described above have a very small sealed housing, the colored powder of which is very compressed. This compressed powder does not alter the gyroscopic movement of the target.

On the other hand, if the housing is very large, if the powder or any other visualization product is poorly compressed, this will result in movement of the product or products in the housing; these products become compressed at the interior of the housing or cavity. This non-homogeneous distribution of the visualization product changes the flight of the target, which slows more rapidly.

To this end, the sealed housing may comprise vertical or substantially vertical partitions, which may take on different shapes, and pass through the center of the housing or not. These partitions may be as tall as the housing so as to form barriers dividing the product in a homogeneous manner and preventing it from turning and modifying the flight of the target.

The accompanying drawings given by way of indicative and non-limiting example will permit readily understanding the invention. They show a preferred embodiment according to the invention.

FIG. 10 is a sectional view of the target or clay pigeon showing the closure system for the diaphragm, by means of a quarter turn or bayonet, showing the diaphragm in position.

FIG. 11 is a sectional view of the target or clay pigeon showing the closure system for the diaphragm by means of a quarter turn or bayonet, showing the diaphragm withdrawn.

Figure 1:
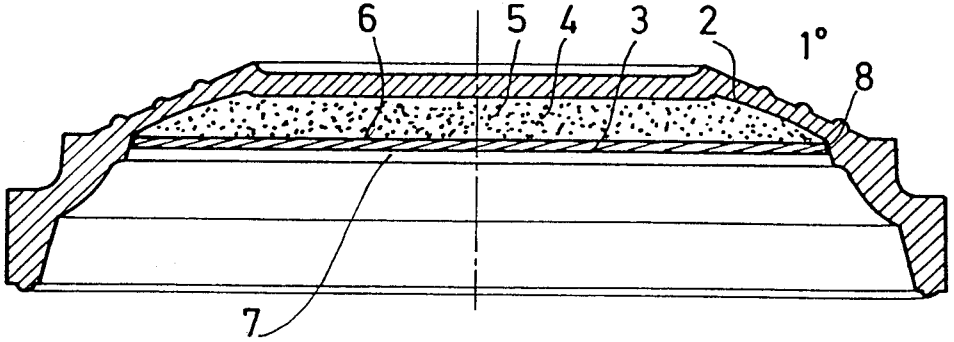
FIG. 1 is a sectional view of a clay pigeon containing a charge of colored powder interiorly of the said pigeon, between its concave portion and the diaphragm. The diaphragm is planar, only its periphery is frustoconical so as to ensure a perfect sealing with the internal surfaces of the said pigeon.
Figure 2:
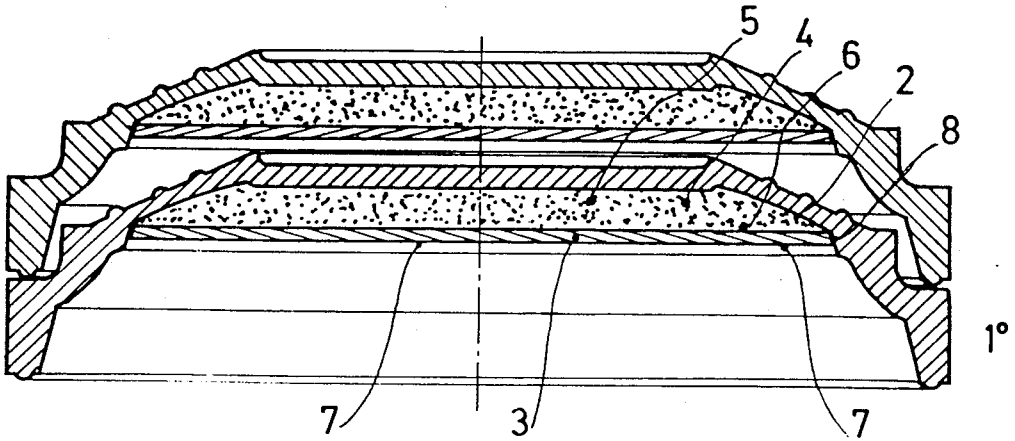
FIG. 2 is a sectional view of two pigeons according to FIG. 1, which are in stacked relation, thus permitting automatic loading and automatic launching.

In FIG. 1, the clay pigeon 1 comprises, on its interior surface 2, between the concave portion of the said interior surface 2 and the diaphragm 3, a housing 4 which contains a charge of colored powder 5. According to this embodiment, the diaphragm 3 is planar, with its top 6 and bottom 7; its side 8 is frustoconical and ensures the tight closing of the housing 4 and the interior surfaces 2 of the clay pigeon. FIG. 2 shows two clay pigeons 1, which are stacked on top of one another.

Figure 3:
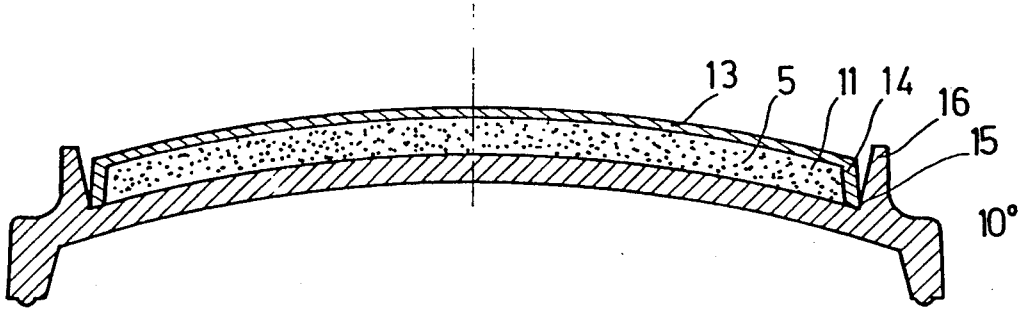
FIG. 3 is a sectional view of a clay pigeon containing a charge of colored powder exteriorly of the said pigeon between its exterior convex surface and a diaphragm, which serves as a cover, and which comes to be encased against the internal surface of the exterior circular flange of the said pigeon.

In FIG. 3, the clay pigeon 10 contains a charge of colored powder 5, which is housed in a housing 11, formed between the convex exterior surface of the said pigeon 10, and a convex diaphragm 13, which covers the assembly and the frustoconical wall 14 of which is fitted against the internal surface 15 of the circular flange 16 of the said pigeon 10.

Figure 4:
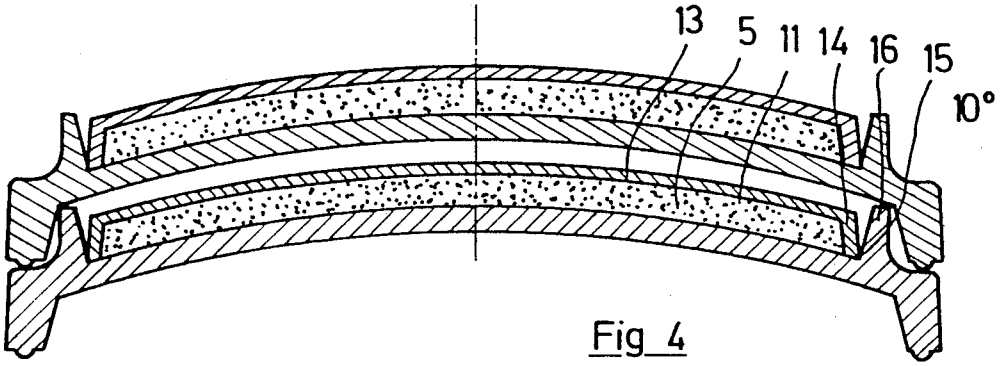
FIG. 4 is a sectional view of two clay pigeons, according to the embodiment shown in FIG. 3, in stacked relation, thus permitting an automatic loading and launching.

FIG. 4 shows two clay pigeons 10 stacked on one another.

Figure 5:
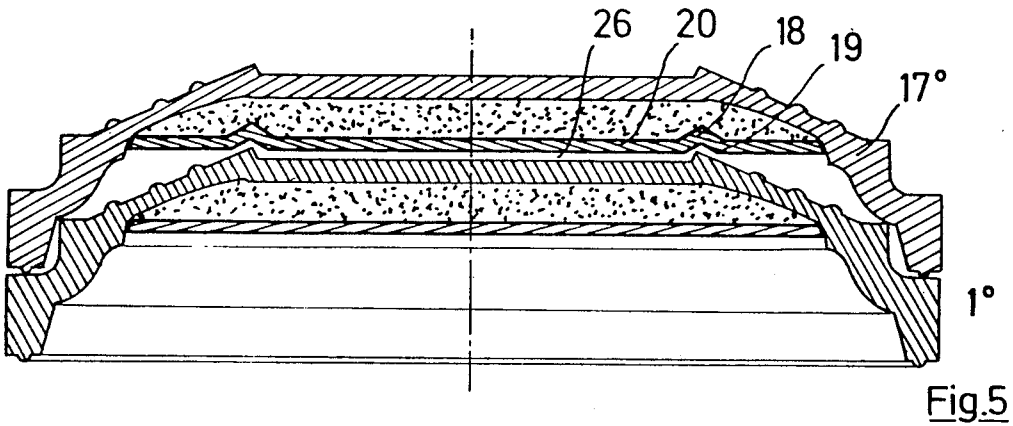
FIG. 5 is a sectional view of two pigeons stacked on top of each other. The upper pigeon comprises a planar diaphragm with a circular flange, which faces the exterior flange of the lower pigeon.

In FIG. 5, the clay pigeon 1 is in stacked relation with a clay pigeon 17, the diaphragm 26 of which comprises a central planar portion 20 and a circular flange 18 which faces the exterior flange 19 of the pigeon 17.

Figure 6:
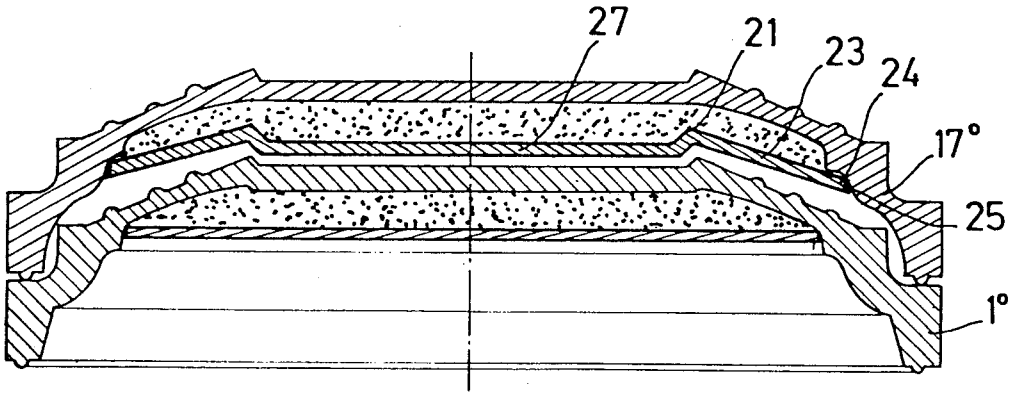
FIG. 6 is a view of two pigeons in stacked relation. The diaphragm of the upper pigeon comprises a planar central portion, a circular flange of reverse slope, then a frustoconical planar portion, the extremity of which, through a frustoconical surface, bears against the internal surface of the pigeon.

In FIG. 6, the clay pigeon 1 is in stacked relation with a clay pigeon 17, the diaphragm 27 of which comprises a central portion 20, a circular flange 21 with a reverse slope, then a frustoconical planar portion 23 the frustoconical extremity 24 of which bears against the internal surface 25 of the said pigeon 17.

Figures 7, 8, 9:
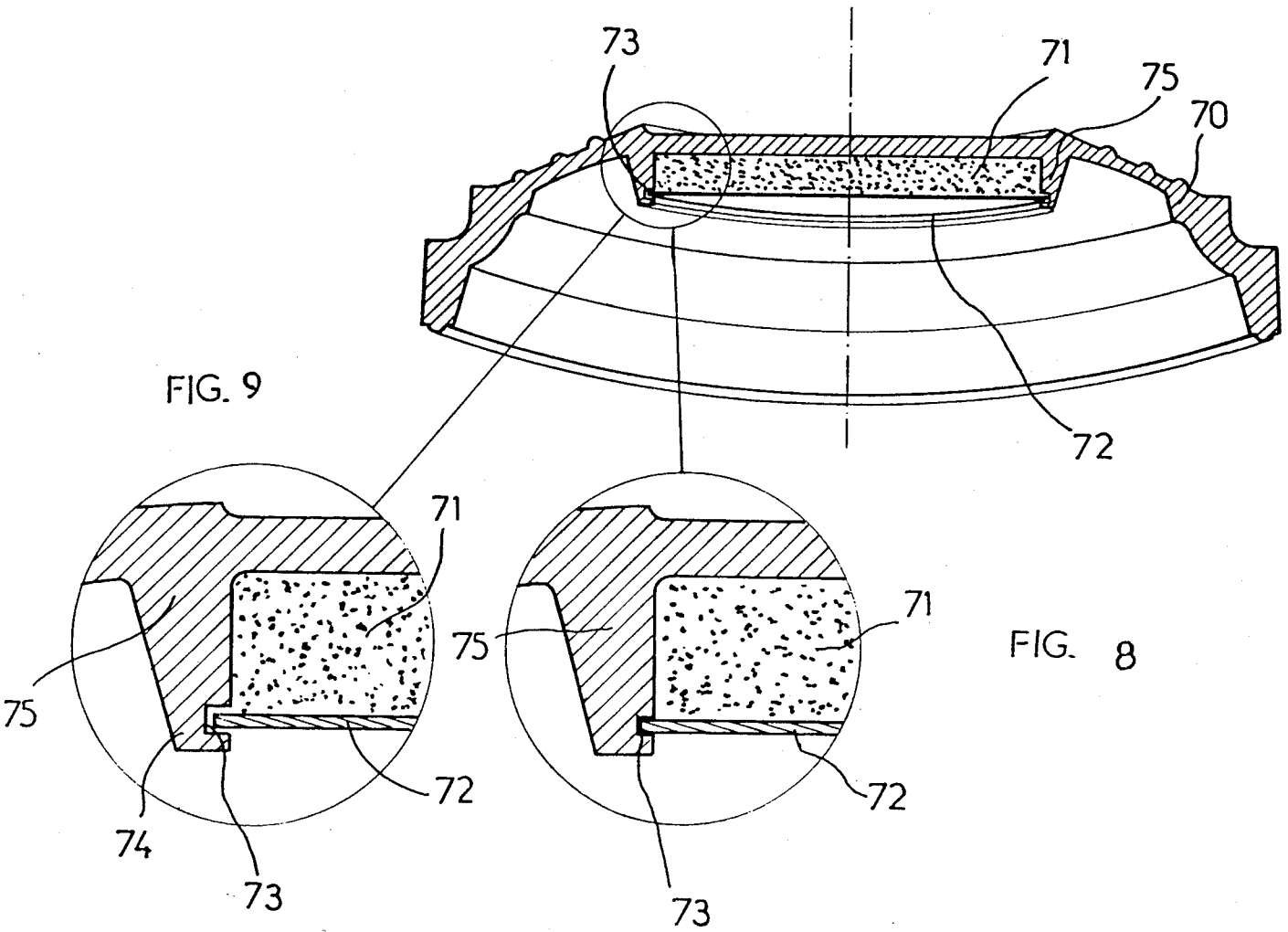
FIG. 7 is a sectional view of a target where the diaphragm is force fitted in a groove.
FIG. 8 is a detail of FIG. 1 at the level of the surface of the housing and the diaphragm.
FIG. 9 is a detail of FIG. 1 at the level of the surfaces of the housing and the diaphragm.

In FIGS. 7, 8 and 9, the clay pigeon or target 70 comprises a housing 71 which is disposed beneath the dome at the level of its internal concave portion.

The diaphragm 72 is of a semi-rigid material; it is force fitted in a substantially horizontal groove 73 disposed at the level of the extremity 74 of the surface 75 of the said housing 71.

In FIGS. 10 and 11, the diaphragm 76 is formed with notches and projections, just at the periphery of the diaphragm 76, to form a bayonet or quarter turn closure system.

Figure 12:
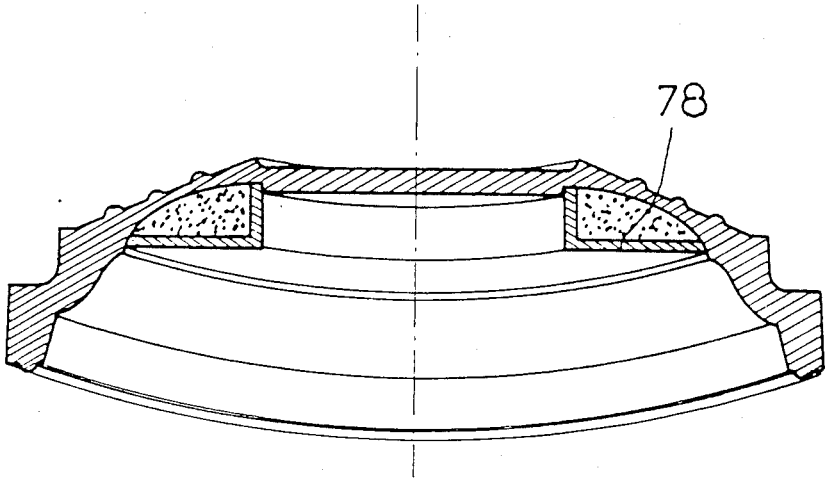
FIG. 12 is a sectional view of a target according to the invention, showing an annular housing at the level of the dome.

In FIG. 12, the housing 78 is formed as an annular region. In this example, this latter is disposed beneath the dome of the target. The housing 78 may have a circular shape, an oval shape or any other shape.

Figure 18:
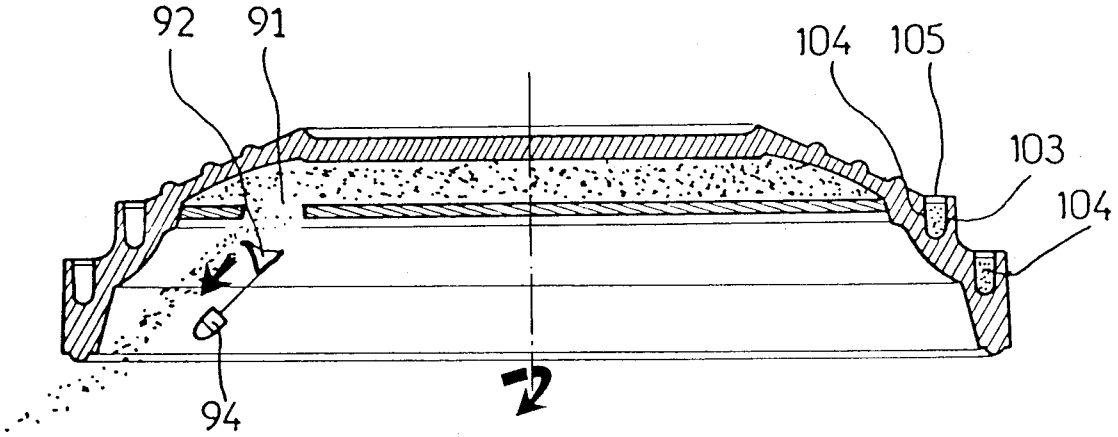
FIG. 18 is a sectional view of a target where the outlet hole is situated on the diaphragm. This hole is hermetically sealed by means of an automatically releasing opening.

The sealed housing 103 of FIG. 18 may be formed by interior or exterior grooves 104, filled with visualization material and closed by adhesive bands 105, serving as a diaphragm.

Figure 13:
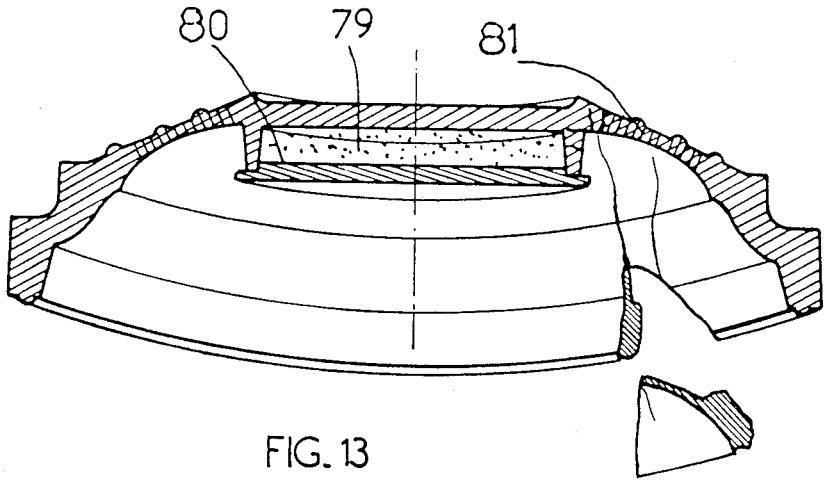
FIG. 13 is a sectional view of a target according to the invention, showing the embrittlement regions.
Figure 14:
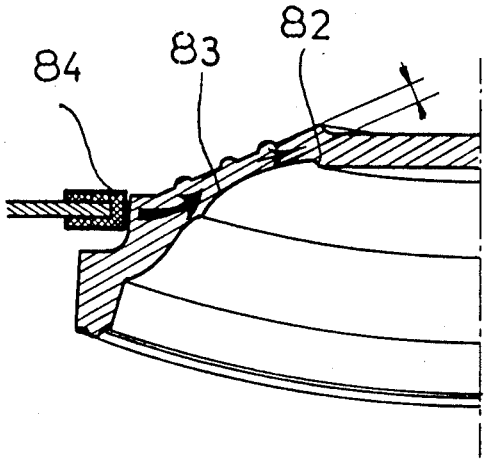
FIG. 14 is a sectional view of a conventional target, in contact with its launching slide.
Figure 15:
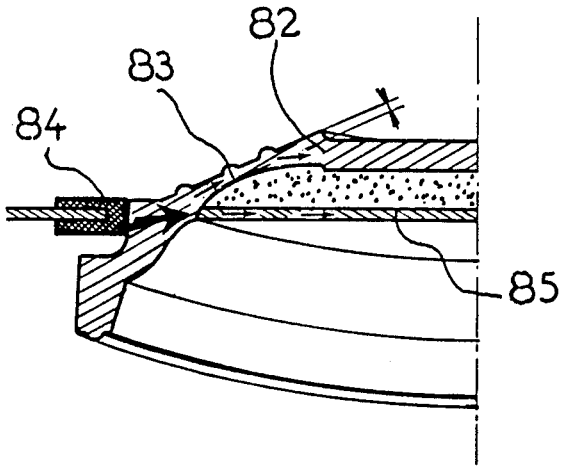
FIG. 15 is a sectional view of a target according to the invention, showing the less thick regions, the forces being distributed between the dome of the target and the diaphragm.

In FIG. 13, it is shown that with the powder 79 employed, the sealed housing 80 may be of a very small size. In certain cases, it may be interesting to embrittle the zone 81 just beneath the summit of the dome, for example by thinning the wall of the target. The same is the case in FIG. 15, where the wall 83 of the target 82 is thinned, the forces being divided, at the moment of launching and rolling on the ramp 84 of the launcher (not shown), between the wall 83 and the diaphragm 85.

According to another embodiment, the target or clay pigeon 86 may comprise a means serving as a stopper which hermetically seals an outlet hole 87. The stopper may automatically or non-automatically open the outlet hole 87. This device permits following by traces the flight of the clay pigeon.

Figure 16:
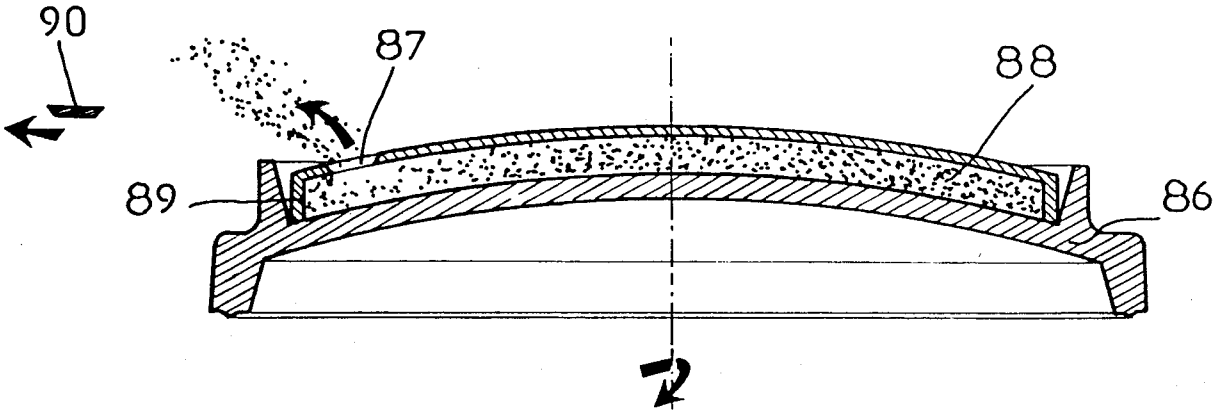
FIG. 16 is a sectional view of a target showing a stopper which forms the outlet hole of the housing, and which is ejected by centrifugal force upon rotation of the target.
Figure 17:
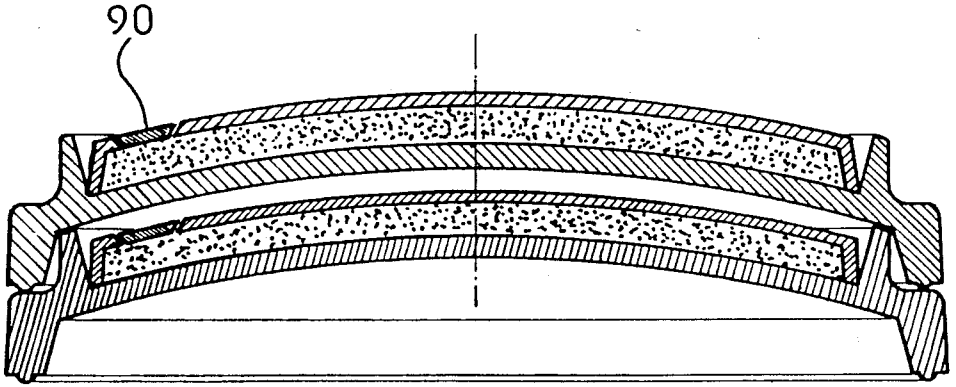
FIG. 17 is a sectional view of a target according to FIG. 16, where the targets are shown stacked.

According to the embodiment shown in FIGS. 16 and 17, the sealed housing 88 comprises a small outlet hole 87 formed by a force fitted stopper 90. The outlet hole 87 is situated at the periphery 89 of the housing 88, and the stopper 90 has a profile such that rotation of the target 86 ejects the said stopper 90, freeing the outlet hole 87, which thus allows a fine stream of powder to escape.

Figure 19:
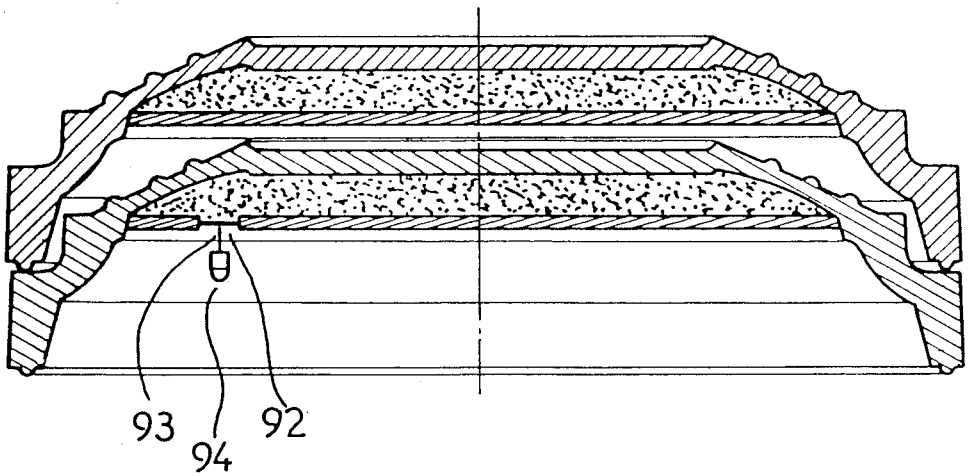
FIG. 19 is a sectional view of a target according to FIG. 18, where the targets are shown stacked.

According to another embodiment, shown in FIGS. 18 and 19, the outlet hole 91 is hermetically sealed by a film 92 of paper, plastic or the like, with automatic opening means, a wire 93 connected to this stopper, the free extremity of which departs from the said film 92 and is connected to a weight 94. Upon rotation of the clay pigeon or target, the weight 94 pulls on the wire 93, and tears the stopper, thus freeing the colored product.

Figure 20:
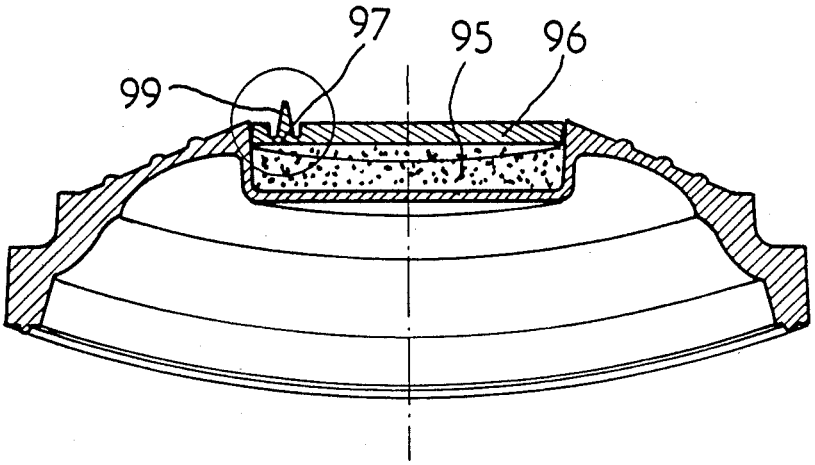
FIGS. 20, 21 and 22 show a target where the release of the opening of the outlet hole is effected by a projection situated at the level of the ramp of the launcher.
Figure 21:
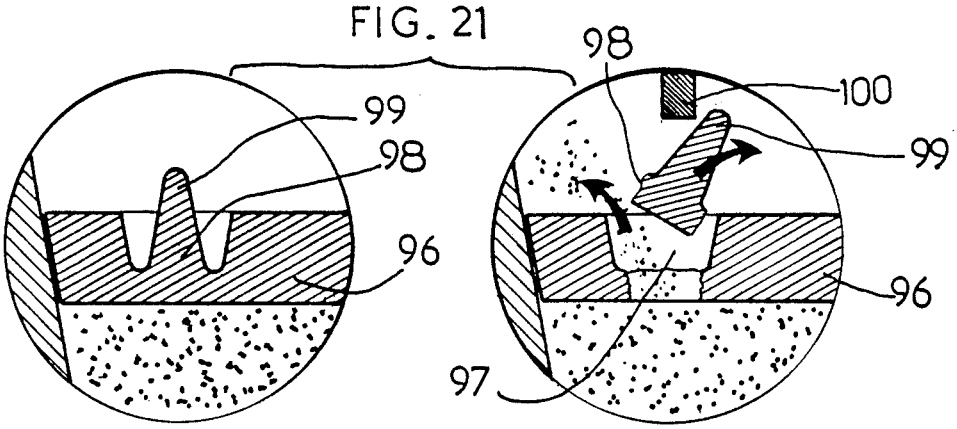
Figure 22:
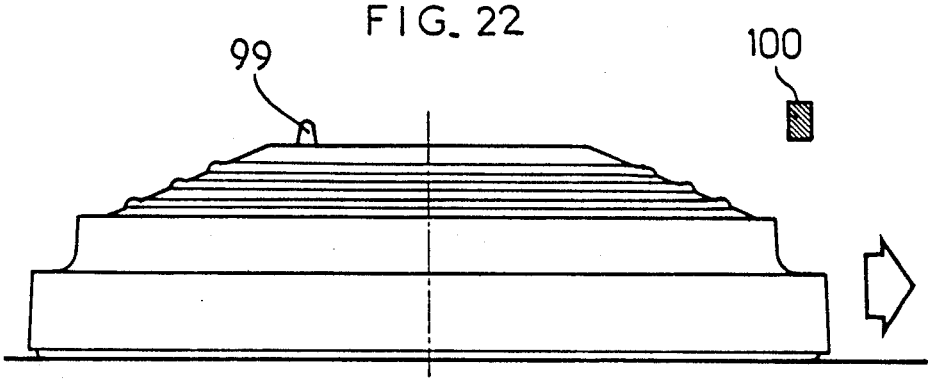

According to another embodiment shown in FIGS. 20, 21 and 22, the sealed housing 95 is closed by a diaphragm 96, the outlet hole 97 of which is closed by a stopper 98 disposed beneath a stud 99. Upon launching of the target, a projection 100, disposed on the launcher, upsets the stud 99 and its stopper 98, thus opening the outlet hole.

The clay pigeons or targets described above have a very small sealed housing, the colored powder of which is very compressed. This compressed powder does not modify the gyroscopic movement of the target.

Figure 23:
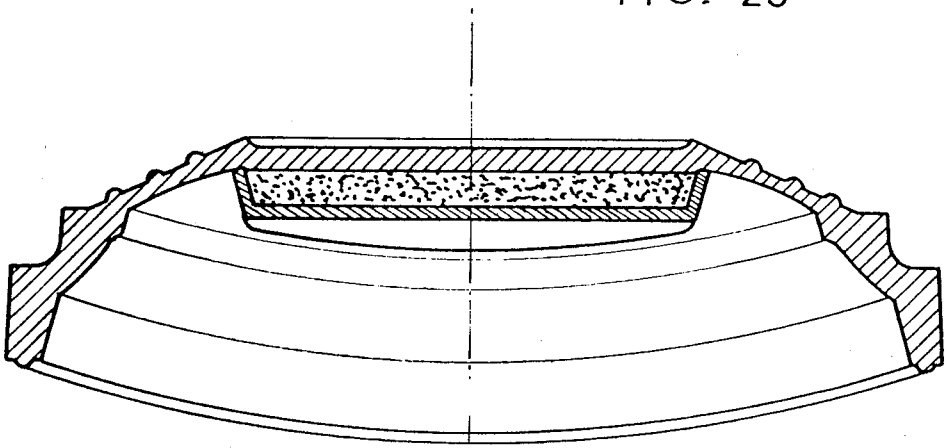
FIG. 23 shows the undesirable division of the visualization product which may be produced when the housing is too large, where the powder is not well compressed or compressible.
Figure 25:
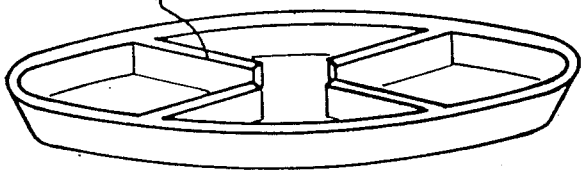
FIG. 25 is a sectional view of the diaphragm comprising vertical partitions or vanes.
Figure 24:
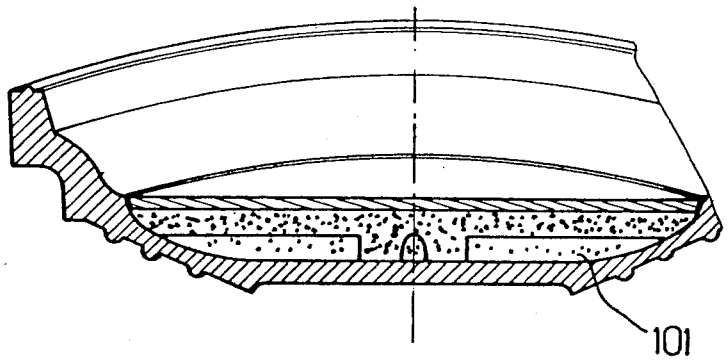
FIG. 24 is a sectional view showing vertical partitions or vanes preventing movement of the visualization product in the cavity or housing.
Figure 26:
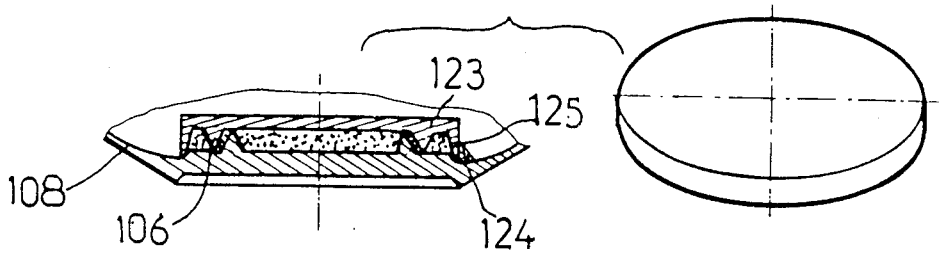
FIG. 26 is a sectional view of the target with a perspective view of the housing.
Figure 27:
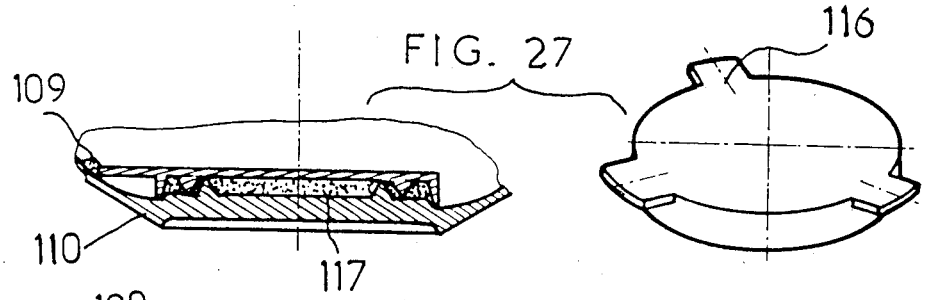
FIG. 27 is a sectional view of the target with a perspective view showing particularly the flanges which serve to transmit the impact on the target and which facilitate opening of the housing.
Figure 28:
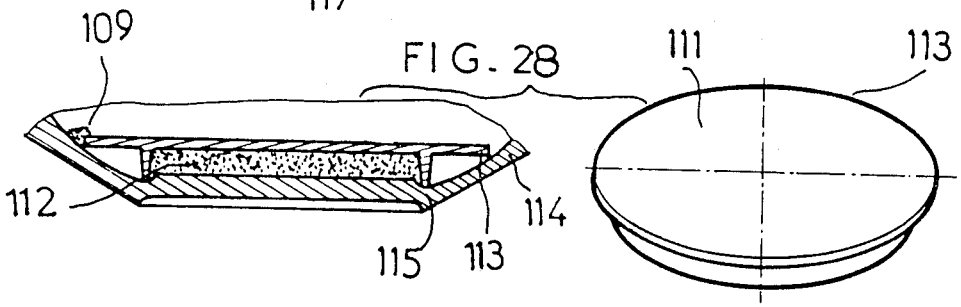
FIG. 28 is a sectional view of the target with a perspective view of the housing showing particularly the circular band which serves to transmit the impact on the target and which facilitates opening of the housing.
Figure 29:
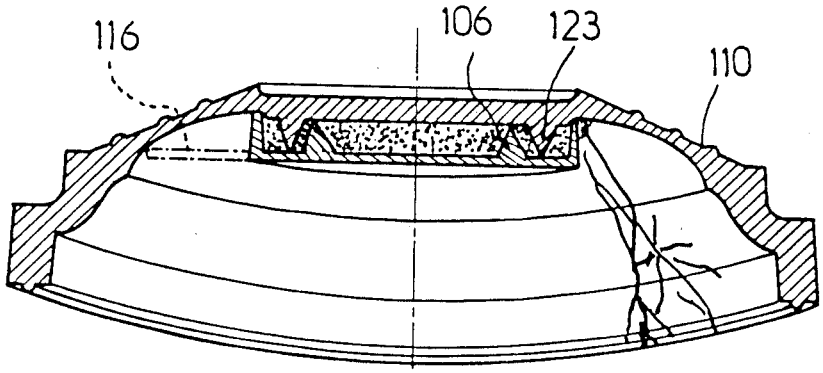
FIG. 29 is a sectional view of the target according to the invention, according to a preferred embodiment, showing particularly an impact transmitter and the baffles formed by the profiled members.

On the other hand, if the housing is very large, if the powder or any other visualization material is poorly compressed, there will result movements of the product or products in the housing; these products becomes compressed at the interior of the housing or cavity. This non-homogeneous distribution of the visualization material changes the flight of the target which slows down more rapidly (see FIG. 23).

To this end, the sealed housing 101 may comprise vertical or substantially vertical partitions 102 which may each have different shapes, passing through the center, or not. These partitions 102 can attain the entire height of the housing so as to form barriers distributing the product in a homogeneous manner and preventing them from rotating.

According to another embodiment shown in FIGS. 26, 27, 28 and 29, the seal between the housing 123 and the target 124 may be assured by the shape of the walls 125 of the housing 123 and the shape of at least one annular wall 106 disposed beneath the dome of the target 108. These shapes together form a "baffle" which assures a better sealing of the housing.

It does not matter if the diaphragm forms the housing and the target the cover or the diaphragm serves only as a closure diaphragm and the housing itself is closed by the wall of the said target.

So as to facilitate the complete fracturing of the target and the opening of the housing to liberate the visualization material, according to another embodiment, the closure and sealing between the housing and the cover is no longer made by a continuous string of glue, but by at least two points 109 of glue, the seal being ensured in this case above all by the baffle formed by the profiled member of the housing and cover.

So as to facilitate the opening of the housing when the target 110 is hit, the housing may be provided with interior elements which serve as impact sensors and transmitters. To this end, an exterior band 111 fixed to the housing 112, comes in contact via its periphery 113 with the edges 114 of the target 115, thus increasing the surface of contact between the target and the housing. This band, when the target is hit, transmits the shock waves to the housing which causes its opening, even if the impact occurs outside of the region of the said housing, for example on the edges of the target.

The means serving as sensor or transmitter may be an assembly of radiating flanges 116 issuing from the housing 117 in contact with the housing 117 by one extremity and in contact with the edge of the target 110 by the other extremity.

We claim:

1. In a flying target comprising a target body having a recess therein, means closing said recess to define with said target body a sealed chamber, and an indicating material in said sealed chamber, the improvement comprising a hole extending between said chamber and the outside of the target and means temporarily sealing said hole, said temporary sealing means being adapted to be dislodged from said hole during launching or flight of said target, thereby to discharge a stream of said indicating material through said hole during flight of said target, said temporary sealing means comprising a weight suspended therefrom, such that rotation of said target during flight imparts centrifugal force to said weight and removes said temporary sealing means.

2. In a flying target comprising a target body having a recess therein, means closing said recess to define with said target body a sealed chamber, and an indicating material in said sealed chamber, the improvement comprising a hole extending between said chamber and the outside of the target and means temporarily sealing said hole, said temporary sealing means being adapted to be dislodged from said hole during launching or flight of said target, thereby to discharge a stream of said indicating material through said hole during flight of said target, said temporary sealing means comprising a stud projecting upwardly beyond said target body, said stud being adapted to cooperate with a corresponding projection means on a launching apparatus, thereby to dislodge said temporary sealing means during launching.

* * * * *